United States Patent [19]

Nordlin

[11] 4,284,113

[45] Aug. 18, 1981

[54] HYDRAULIC LOG SPLITTER

[75] Inventor: William F. Nordlin, Coloma, Mich.

[73] Assignee: Auto Specialties Manufacturing Company, St. Joseph, Mich.

[21] Appl. No.: 105,612

[22] Filed: Dec. 20, 1979

[51] Int. Cl.[3] ..... B27L 7/00

[52] U.S. Cl. ..... 144/193 A; 60/479; 60/486; 144/193 R; 144/193 E

[58] Field of Search ..... 254/93 H, 93 HP, 104; 60/428, 477, 479, 481, 486; 144/193 R, 193 A, 193 C, 193 D, 193 E

[56] References Cited

U.S. PATENT DOCUMENTS

| | | | |
|---|---|---|---|
| 2,548,902 | 4/1951 | Mueller . | |
| 2,548,903 | 4/1951 | Mueller . | |
| 2,654,568 | 10/1953 | Pine | 254/93 H |
| 2,659,307 | 11/1953 | Framhein | 60/479 X |
| 2,664,073 | 12/1953 | Pine | 254/93 H |
| 3,242,955 | 3/1966 | Hellstrom | 144/193 A |
| 3,640,323 | 2/1972 | Helle | 144/193 A |
| 3,982,572 | 9/1976 | Kortendick | 254/104 X |
| 4,102,373 | 7/1978 | Winiasz | 254/104 X |
| 4,103,724 | 8/1978 | Braid | 144/193 A |

FOREIGN PATENT DOCUMENTS

| | | | |
|---|---|---|---|
| 568158 | 3/1977 | Switzerland | 254/93 H |

*Primary Examiner*—W. D. Bray

*Attorney, Agent, or Firm*—Trexler, Wolters, Bushnell & Fosse, Ltd.

[57] ABSTRACT

A manually operated log splitter is provided. The log splitter comprises a bi-ended main beam, a splitter wedge fixed at one end of the main beam, and manually operated hydraulic power means fixed to the other end of the beam. In accordance with the invention, this hydraulic power means includes a ram reciprocably moveable toward and away from the splitter wedge. A manually operated low pressure, high volume pump and a manually operated high pressure, low volume pump urge the ram toward the wedge. Automatically operable release valve means relieves pressure from the high pressure, low volume pump to the reservoir when necessary.

7 Claims, 9 Drawing Figures

HYDRAULIC LOG SPLITTER

BACKGROUND OF THE INVENTION

This invention relates generally to hydraulic mechanisms for log splitters and like devices.

Log splitting devices are meeting a commercial demand from persons in wooded areas. In general, many such devices include a main beam or rail, and a wedge fixed at one end. A ram or pushing device is mounted at the other end. When a log is placed between the ram and the wedge and the ram is operated to force the log toward and over the wedge, the log is split accurately and neatly. A minimum of effort is needed by the user of the log splitting device, and minimal exposure to danger is obtained. No large, heavy axe is required, and the sometimes dramatic dangers attendant to the use of an axe are obviated.

Log splitters previously offered by others have not been entirely accepted in the marketplace, however. Customers have been reluctant to purchase these previously offered devices, apparently because the devices have not been efficient, or they have not been protected from overload, or they have been too expensive, or they have exhibited a combination of these and other disadvantages.

It is accordingly the general object of the present invention to provide a low cost log splitter which is easy and simple to operate, yet which is of a reliable and rugged design.

It is another object to provide a ram mechanism for a log splitter which includes an overload-protecting relief valve offering a safe upper limit to the splitting force available in the device. A related object is to provide a relief valve-protected log splitter in which the splitting force is maintained on the log in the mechanism even if the relief valve operates, thereby allowing the wedge to progressively work its way through an obstruction such as a knot in the log.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
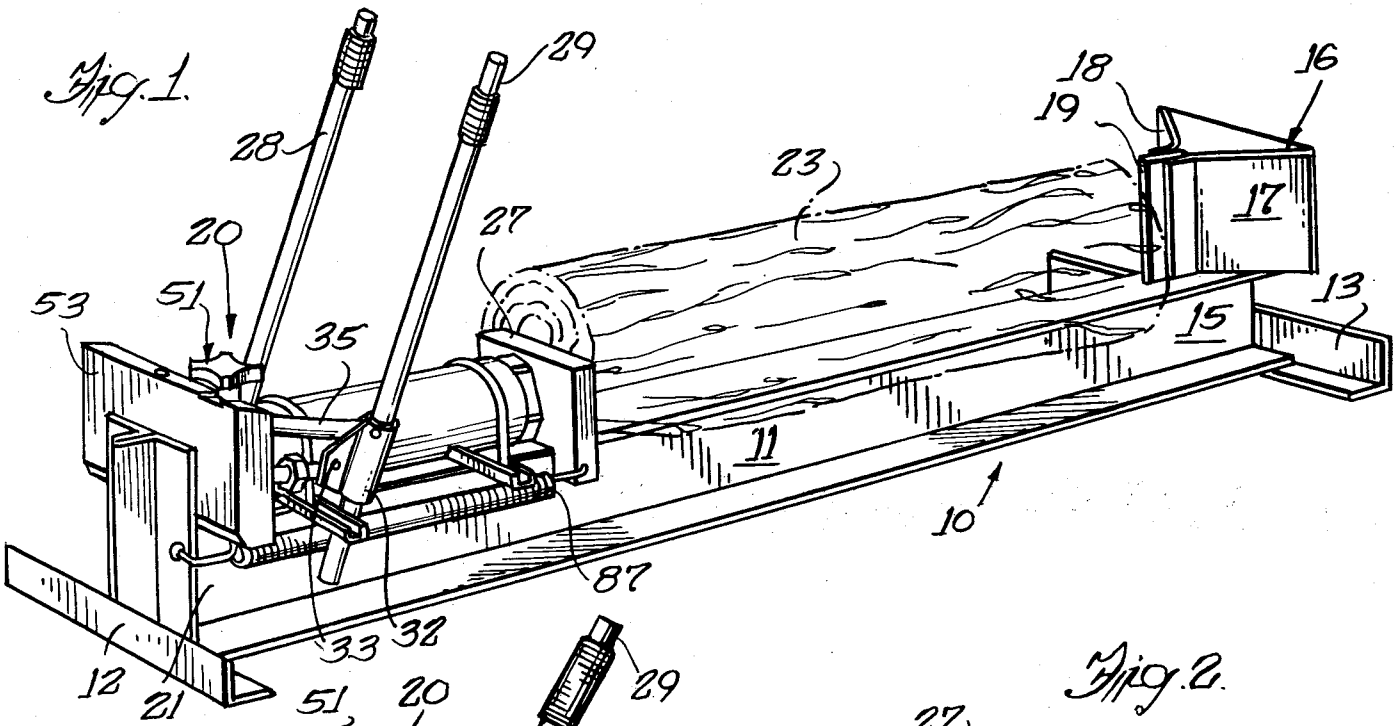
FIG. 1 is an overall perspective view of the novel log splitter.
Figure 2:
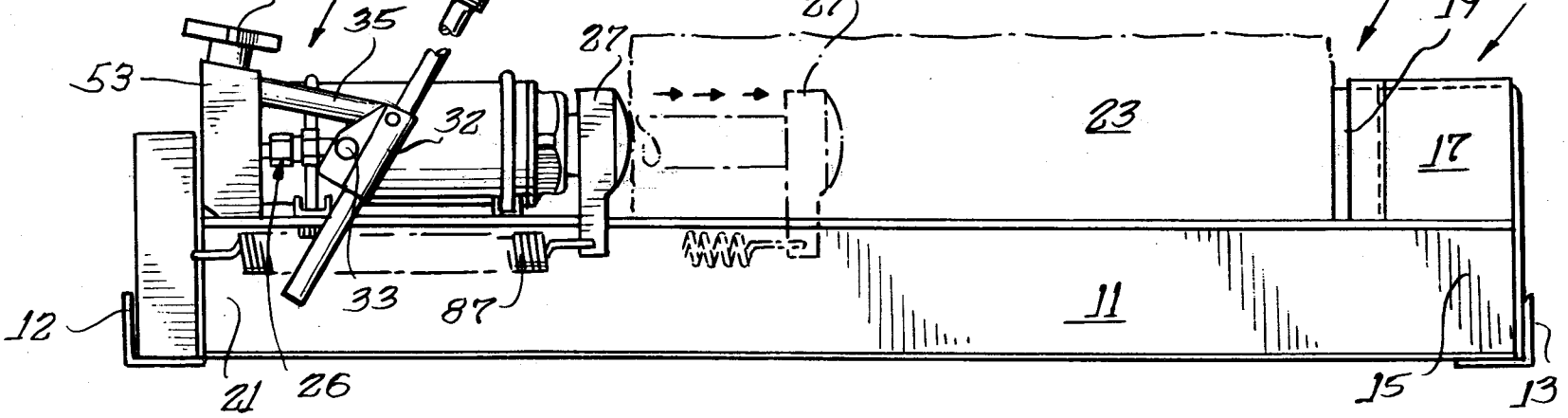
FIG. 2 is a side elevational view of the log splitter shown in FIG. 1.
Figure 3:
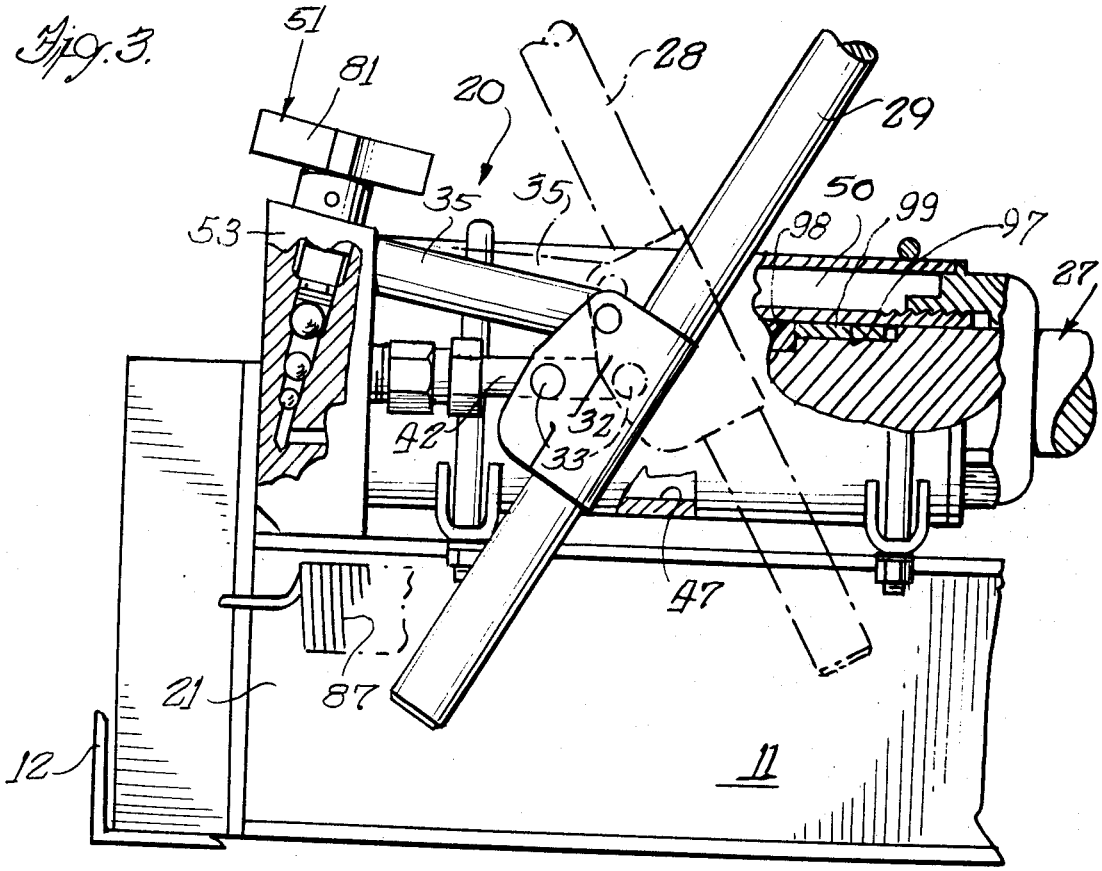
FIG. 3 is a fragmentary side elevational view of the log splitter of FIGS. 1 and 2 showing in further detail portions of the ram mechanism.

Turning first to FIGS. 1 and 2, there is shown a log splitter 10 embodying the present invention. In general, this log splitter 10 includes a main beam or rail 11 which can be formed of an ordinary wide flange structural beam or similar member. Angle irons 12 and 13 are welded to the main beam 11 to provide suitable bearing on the earth or other work location.

At one end 15 of the beam 11, a splitter wedge 16 is fixed by welding or other suitable means. Here, this splitter wedge 16 includes divergently flanged plates 17 and 18 which mount a starting knife or chisel 19. A manually operated hydraulic power means 20, fixed to the other end 21 of the main beam 11, urges a log 23 toward and against the chisel 19 and wedge 16. As the log 23 is moved progressively toward and over the wedge 16, the log is split. When the power ram 20 is reset, another log can be positioned in the log splitter 10 and the process repeated.

Figure 4:
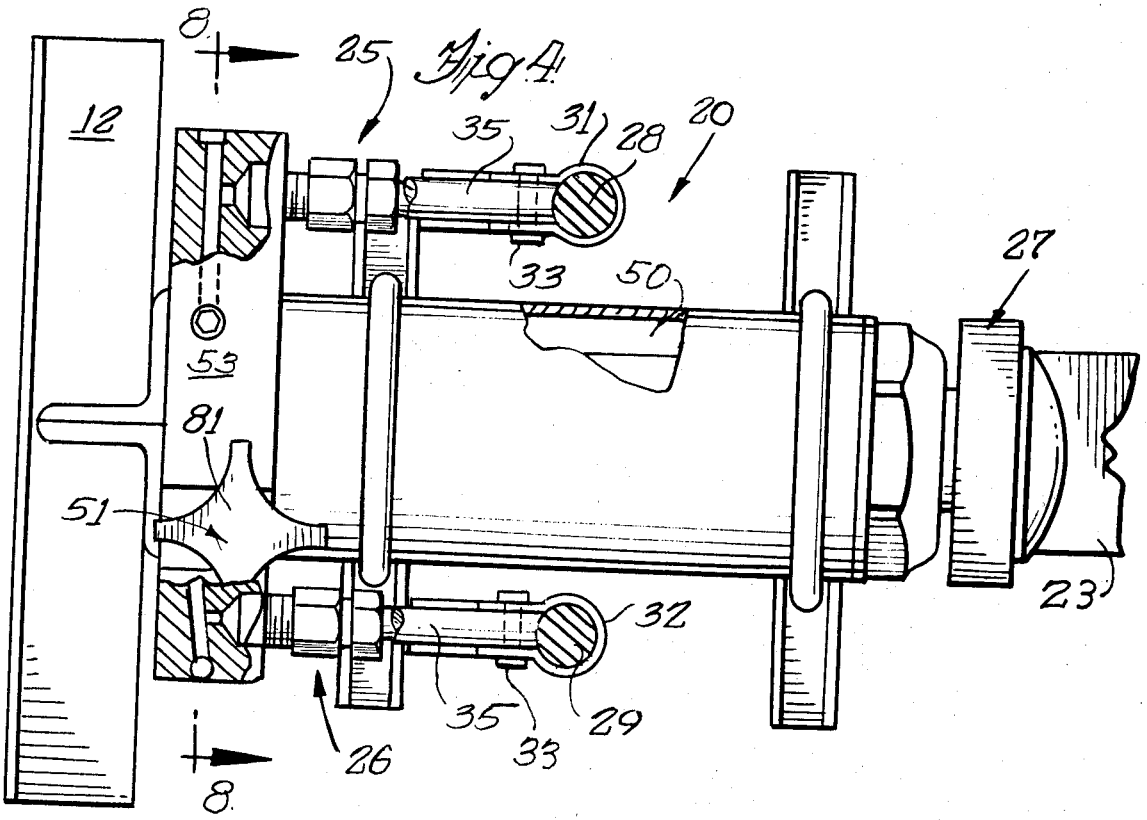
FIG. 4 is a top plan view in partial section showing yet further details of the splitter ram mechanism.
Figure 5:
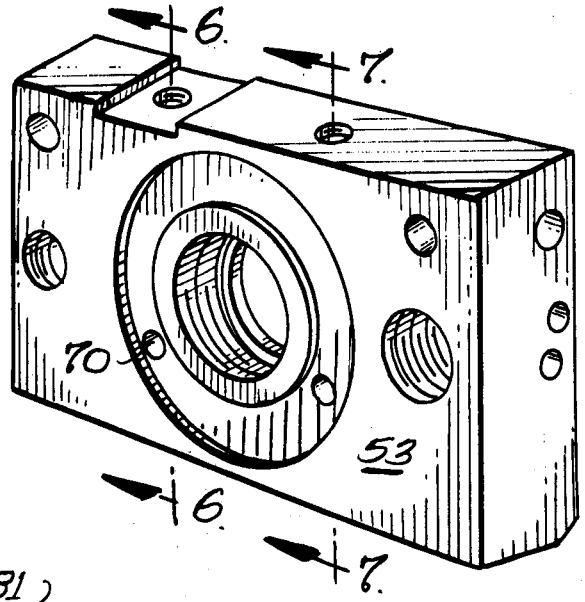
FIG. 5 is a perspective view of the ram mechanism base plate.

In accordance with one aspect of the invention, and as shown particularly in FIG. 4, this manually operated power device 20 includes a manually operated low pressure-high volume pump 25, and a manually operated high pressure-low volume pump 26. Independently or together, these pumps 25 and 26 can be operated to urge a ram member 27 toward the wedge 17.

As shown in FIGS. 1–4, the manually operated pumps 25 and 26 are of the plunger or piston variety, and are operated by elongated handles 28 and 29. These handles—and, consequently, the pumps—can be operated individually or singly. Some operators find easy, rapid log splitter operation can be accomplished by oppositely reciprocating the handles; that is, handle 28 is pushed forward as handle 29 is drawn backward towards the user, and when the end of each pump stroke is reached, the handle motion is simultaneously reversed. The log splitter can also be rapidly operated by simultaneously operating the handles 28 in the same direction; that is, by pushing both handles 28 and 29 away from the user, and when the end of each stroke is reached, by simultaneously pulling the handles 28 and 29 toward the user.

Handle sockets 31 and 32 receive the respective handles 28 and 29, and are pivoted, as at 33. Links 34 and 35 transmit reciprocal force from handles and sockets to link pins 38 and 39 at the top of the pump pistons 41 and 42. These pump pistons reciprocate in pump cylinders 43 and 44; the cylinders, in turn, are screwed or otherwise secured partly within a base plate 53.

Figure 6:
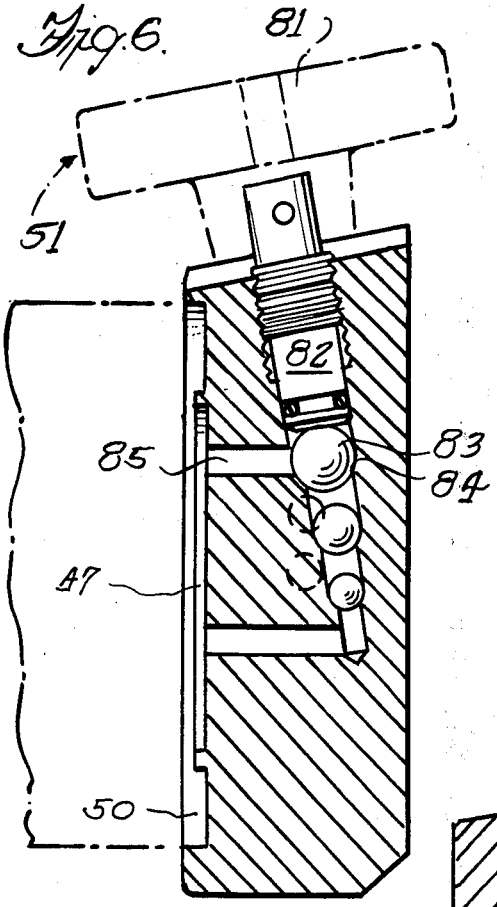
FIG. 6 is a fragmentary sectional view taken substantially in the plane of line 6—6 of FIG. 5.
Figure 7:
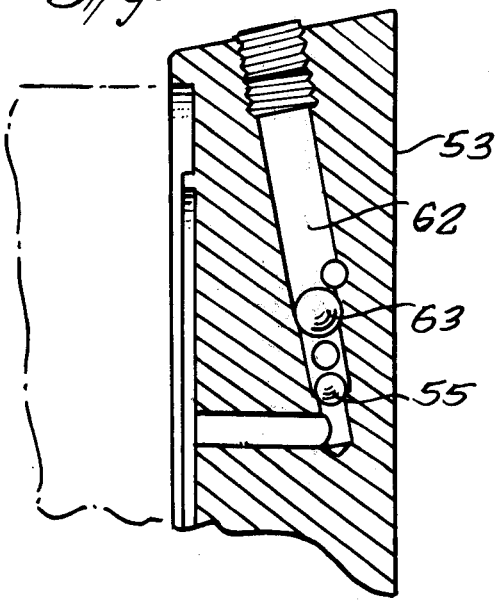
FIG. 7 is a fragmentary sectional view taken substantially in the plane of line 7—7 in FIG. 5.
Figure 8:
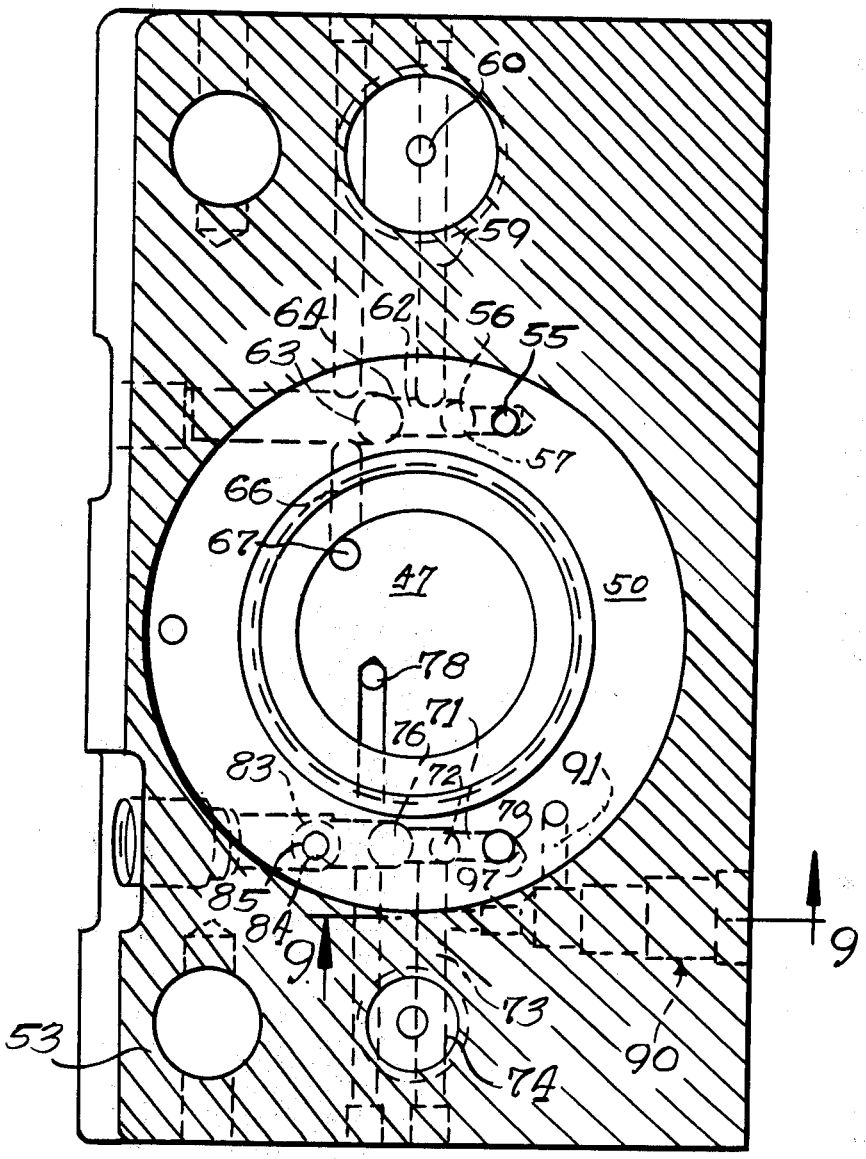
FIG. 8 is a sectional view taken substantially in the plane of line 8—8 in FIG. 4.

The reciprocal action of these pump pistons 41 and 42 pressurizes a ram chamber 47 and urges the ram 27 toward the log as described above. To accomplish this, hydraulic fluid is drawn from a reservoir 50 surrounding the ram 27, is pressurized, and is urged into a ram chamber 47 (FIGS. 6 and 8). After the log 23 has been split, a relief valve 51 is operated so as to return fluid from the ram chamber to the reservoir 50.

In the present embodiment of the invention, these fluid flows are accomplished through passages formed in the ram base plate 53. As can be seen in FIGS. 5–9, fluid is drawn to the high volume pump through a reservoir port 55, past a ball check valve member 56 which normally seats upon the seat 57. As the high volume-low pressure pump is operated, however, this ball 56 unseats and permits fluid flow. Fluid moving past the ball 56 flows down a passage 59 to an intersecting vertically orienting passage 60 and into a chamber formed below the piston 41 on the low perssure pump 25. As the piston 41 is pushed downwardly upon the fluid by force applied to the appropriate handle 28, pressurized fluid is pushed back down the passageways 60 and 59 and toward the check valve ball 56, causing that ball to seat against its seat 57 and to inhibit further flow back to the reservoir. The pressurized fluid now flows in an opposite direction along the passage 62 and past a second check valve ball 63 and its mating seat 64. The pressurized fluid then moves toward and along a passage 66 and a vertical riser passage 67 and into the ram chamber 47.

Fluid flow and pump pressurization action for the high pressure pump is somewhat similar. That is, fluid is drawn from the reservoir through a reservoir port 70 and right-angle conduit 71 past a ball-type check valve 72 and along a passage 73 into a chamber 74 below the piston 42 of the high volume-low pressure pump. As the pump piston is urged into the pump, the fluid is pressurized and moves back along the conduit 73. This action closes the first ball check valve 72, but opens a second ball check valve 76. Fluid moving past this second check valve 76 moves along a passage 78 and is admitted to the ram chamber 47. Fluid is prevented from leaving the ram chamber 47 by the reseating and closing of the second check valve ball 76.

When the log splitter operator desires to retract the ram, he operates the relief valve 51 by turning the operating knob 81. As shown particularly in FIGS. 6 and 8, this action withdraws a stem 82 and permits a relief valve check ball 83 to unseat from an associated seat 84. Fluid is then permitted to move from the ram chamber down the passage 78, along the cross passage 71, past the exhaust or relief valve seat 84 and associated ball 83, and up a riser passage 85 and back into the reservoir 50. As pressure is released, a return spring 87 (FIGS. 1–3) applies retractive force to the ram 27, and causes the ram to be withdrawn to its original position. This retractive ram action returns fluid from the ram chamber to the reservoir, as described above.

Figure 9:
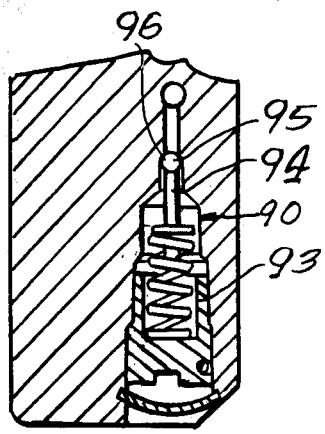
FIG. 9 is a fragmentary sectional view taken substantially in the plane of line 9—9 in FIG. 8.

In accordance with another aspect of the invention, automatically operable relief valve means are provided for relieving pressure from the high pressure-low volume pump to the reservoir. In this way, correctly pressurized fluid in the ram chamber 50 is not disturbed and log splitter use can be resumed immediately once the overpressured conditions have been corrected. Thus, the entire pressurization and splitting cycle need not be restarted from a ram-retracted, unpressurized condition. To this end, a relief valve mechanism 90, as shown in FIGS. 8 and 9, is located in the power device 20. This relief valve mechanism 90 includes a communicator passage 91 which provides a fluid flow path to the conduit 73. Thus, fluid which is overpressurized in the high pressure pump chamber 74 can escape along the communicating passage 73 past the relief valve 90 and down the communicating passage 91 to the reservoir 50. The illustrated relief valve includes an expansion plug of known type 93 and an overload plunger 94 which engages a ball 95 and seats that relief ball 95 against a seat 96. When pressure exceeds the pre-set pressure relief valve actuating value, the plunger 94 retracts, the ball 95 unseats, and fluid flows between the ball 95 and seat 96 (FIG. 9) along the passages described. It will be noted that this pressure relief device means that the inner surface 97 of the ram pressure chamber is free of any apertures or openings over that surface portion which is swept or engaged by ram seals 98. A collar 99 carried inside the cylinder prevents over-extension of the ram 27 from the ram cylinder.

The invention is claimed as follows:

1. A manually operated log splitter, comprising a bi-ended main beam, a splitter wedge fixed at one end of the main beam, and manually operated hydraulic power means fixed to the other end of the main beam and having a ram reciprocably movable at least partly out of and away from a pressurizable ram chamber toward the splitter wedge for urging logs against the wedge to split them, the manually operated power means further comprising a plurality of independent manually operated reciprocating pumps for urging the ram toward the wedge, automatically operable relief valve means and fluid conduit means providing a fluid passage between one of the manually operated pumps and a reservoir but functionally independent of the other pump for relieving pressure from that pump only to the reservoir, and manually operable relief valve means separate from the automatically operable relief valve means and in fluid communication with the ram chamber and reservoir.

2. A manually operated log splitter, comprising a bi-ended main beam, a splitter wedge fixed at one end of the main beam, and manually operated hydraulic power means fixed to the other end of the main beam and having a ram reciprocably movable at least partially out of a pressurizable ram chamber toward the splitter wedge for urging logs against the wedge to split them, the manually operated power means further comprising a hydraulic fluid reservoir, a low pressure-high volume pump manually operable for urging the ram toward the wedge quickly but with low splitting force, a high pressure-low volume pump manually operable independently of the low pressure-high volume pump for urging the ram toward the wedge slowly but with high splitting force, automatically operable relief valve means for relieving pressure from the high pressure-low volume pump to the reservoir, and manually operable relief valve means separate from the automatically operable relief valve means and in fluid communication with the ram chamber and reservoir.

3. A log splitter according to claim 1 or 2 wherein said power means includes a base member defining a relief passage leading from the high pressure pump to the reservoir, the relief passage being out of fluid communication with the low pressure pump, and wherein the relief valve includes an operative element located in said relief passage, thereby providing an upper limit to the maximum pressure obtainable in the high pressure pump and ram chamber without causing excessive pressure relief in the ram chamber itself.

4. A log splitter according to claim 1 wherein said ram chamber is defined by an inner cylinder surface, the combination further including a ram-ram cylinder sealing device attached to said ram for reciprocation therewith and positioned to contact and sweep over a predefined swept portion of the ram chamber inner cylinder surface, the inner cylinder surface being free of any apertures engageable by the sealing device during its sweeping motion.

5. A log splitter according to claim 1 or 2 including collar means mounted on said ram means and reciprocable therewith so as to engage a portion of the ram cylinder and prevent over-extension of the ram from the ram cylinder.

6. A hydraulic device, comprising a ram, a ram cylinder, a hydraulic fluid reservoir, a low pressure-high volume pump manually operable for extending the ram out of the cylinder with low force, a high pressure-low volume pump manually operable independently of the low pressure-high volume pump for extending the ram out of the cylinder with high force, automatically operable relief valve means for relieving pressure from the high pressure-low volume pump only to the reservoir, and manually operable relief valve means separate from the automatically operable relief valve means and in fluid communication with the ram chamber and reservoir.

7. A hydraulic device according to claim 6 wherein said device includes a base member defining a relief passage leading from the high pressure pump to the reservoir, but out of fluid communication with the low pressure pump, and wherein the relief valve includes an operative element located in said relief passage, thereby providing an upper limit to the maximum pressure obtainable in the high pressure pump and ram chamber without causing excessive pressure relief in the ram chamber itself.

* * * * *